US007999466B2

(12) United States Patent
Koh et al.

(10) Patent No.: US 7,999,466 B2
(45) Date of Patent: Aug. 16, 2011

(54) DISPLAY DEVICE WITH POWER GENERATOR ON PANEL COVER AND MANUFACTURING METHOD THEREOF

(75) Inventors: Byung-Sik Koh, Gwangmyeong-si (KR); Chun-Seok Ko, Hwaseong-si (KR); Byoung-Seong Jeong, Yongin-si (KR); Si-Duk Sung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 994 days.

(21) Appl. No.: 11/768,512

(22) Filed: Jun. 26, 2007

(65) Prior Publication Data

US 2008/0001940 A1 Jan. 3, 2008

(30) Foreign Application Priority Data

Jun. 30, 2006 (KR) ..... 10-2006-0060520

(51) Int. Cl.
*G09G 3/30* (2006.01)
*G09G 3/28* (2006.01)

(52) U.S. Cl. ..... 313/512; 313/498; 313/507; 313/508; 315/169.4

(58) Field of Classification Search ..... 313/501–512
See application file for complete search history.

(56) References Cited

U.S. PATENT DOCUMENTS

| | | | | |
|---|---|---|---|---|
| 6,657,620 | B2 * | 12/2003 | Oishi et al. | 345/204 |
| 2005/0184656 | A1 * | 8/2005 | Kim et al. | 313/504 |
| 2006/0017665 | A1 * | 1/2006 | Ko et al. | 345/76 |
| 2006/0055313 | A1 * | 3/2006 | Bae et al. | 313/500 |
| 2006/0103619 | A1 * | 5/2006 | Kim | 345/98 |
| 2006/0214881 | A1 * | 9/2006 | Kim et al. | 345/60 |

FOREIGN PATENT DOCUMENTS

| | | |
|---|---|---|
| JP | 2000058255 | 2/2000 |
| JP | 2004119967 | 4/2004 |
| KR | 1020060000853 | 1/2006 |

* cited by examiner

*Primary Examiner* — Anne Hines
*Assistant Examiner* — Tracie Green
(74) *Attorney, Agent, or Firm* — H.C. Park & Associates, PLC

(57) ABSTRACT

A display device includes a display panel having a display region formed with a plurality of thin film transistors, a light emitting layer disposed in the display region, and a driver supplying a driving signal including a gate signal and a data signal to the thin film transistors. At least one voltage pad is disposed outside of the display region on the display panel to supply a reference voltage to the display region, a power generator generates the reference voltage, and a flexible film is connected between the voltage pad and the power generator to transmit the reference voltage. At least one of the driver and the power generator includes an external power input unit that receives external power.

17 Claims, 7 Drawing Sheets

DISPLAY DEVICE WITH POWER GENERATOR ON PANEL COVER AND MANUFACTURING METHOD THEREOF

CROSS-REFERENCE TO RELATED APPLICATIONS

This application claims priority from and the benefit of Korean Patent Application No. 10-2006-0060520, filed on Jun. 30, 2006, in the Korean Intellectual Property Office, the disclosure of which is incorporated herein by reference for all purposes as if fully set forth herein.

BACKGROUND OF THE INVENTION

1. Field of Invention

The present invention relates to a display device and a manufacturing method thereof, and more particularly, to a display device which comprises a panel cover to protect and support a display panel, and a manufacturing method thereof.

2. Discussion of the Background

The use of organic light emitting diode (OLED) technology in flat panel displays has recently attracted attention because it provides for flat panel displays that require low driving voltage, are thin and lightweight, have wide viewing angles; and have relatively short response times.

An OLED substrate includes a switching transistor disposed at a crossing of a gate line and a data line and a driving transistor connected to a voltage supply line through which a driving voltage is applied, thereby forming a pixel. Further, the OLED substrate includes a voltage supplying pad for supplying a common voltage corresponding to a reference voltage to a cathode electrode, and a driving voltage to a voltage supply line.

As the size of a display device increases and the number of pixels needed for high resolution increases, it becomes more difficult to fully supply the common voltage and the driving voltage to the pixels. Currently, to enhance the stability of power supply and the uniformity of the substrate, a printed circuit board (PCB) and a flexible printed circuit (FPC), which are provided separately from a driver and placed in a lateral side of the substrate, have been employed for supplying the common voltage or the driving voltage.

However, using a plurality of PCBs increases production costs because of the need to mount the PCBs. Also, the complicated structure of the PCBs may make it difficult to modularize the OLED substrate into the display device.

SUMMARY OF THE INVENTION

The present invention provides a display device that may have an improved structure for facilitating modularization.

The present invention also provides a method for manufacturing the display device.

Additional features of the present invention will be set forth in part in the description which follows and, in part, will be apparent from the description, or may be learned by practice of the present invention.

The present invention provides a display device including a display panel having a display region including a plurality of thin film transistors, a light emitting layer disposed in the display region, and a driver supplying a driving signal including a gate signal and a data signal to the thin film transistor. The display device further includes at least one voltage pad disposed outside of the display region on the display panel and supplying a reference voltage to the display region, a power generator generating the reference voltage, and a flexible film connected between the voltage pad and the power generator and transmitting the reference voltage, wherein at least one of the driver and the power generator includes an external power input unit to receive external power.

The present invention also discloses a method of manufacturing a display device. Among steps, it provides a display panel having a display region including a light emitting layer and a voltage pad to supply a predetermined voltage to the display region. It also provides an encapsulation substrate to encapsulate the display region on the display panel and connects the voltage pad with a first end of a flexible film. The method further includes providing a panel cover, which has a power generator to generate a reference voltage to be supplied to the display region, on the encapsulation substrate and bending the flexible film and connecting a second end of the flexible film, which is not connected with the voltage pad, to the power generator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, show embodiments of the invention, and together with the description serve to explain the principles of the present invention.

DETAILED DESCRIPTION OF ILLUSTRATED EMBODIMENTS

Figure 1:
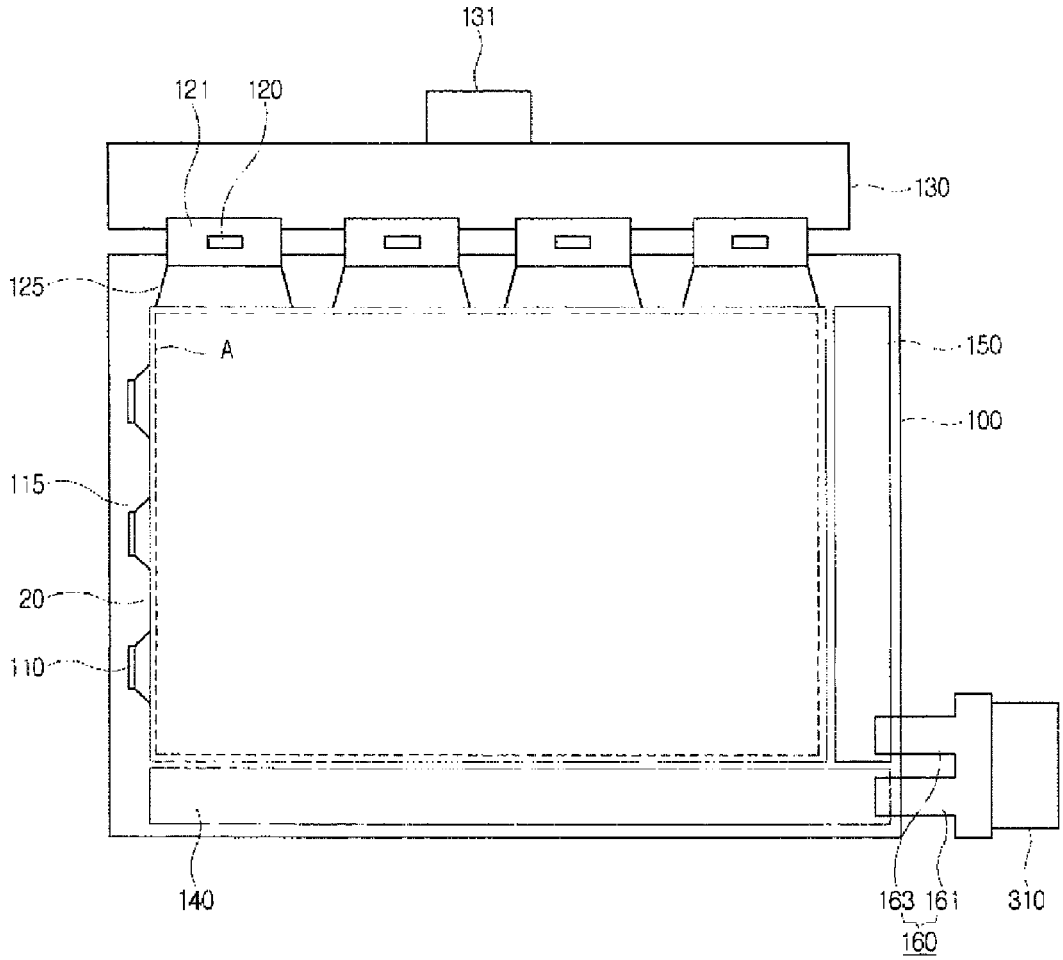
FIG. 1 is a plan view of a display device according to a first exemplary embodiment of the present invention.

The present invention is described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawing denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
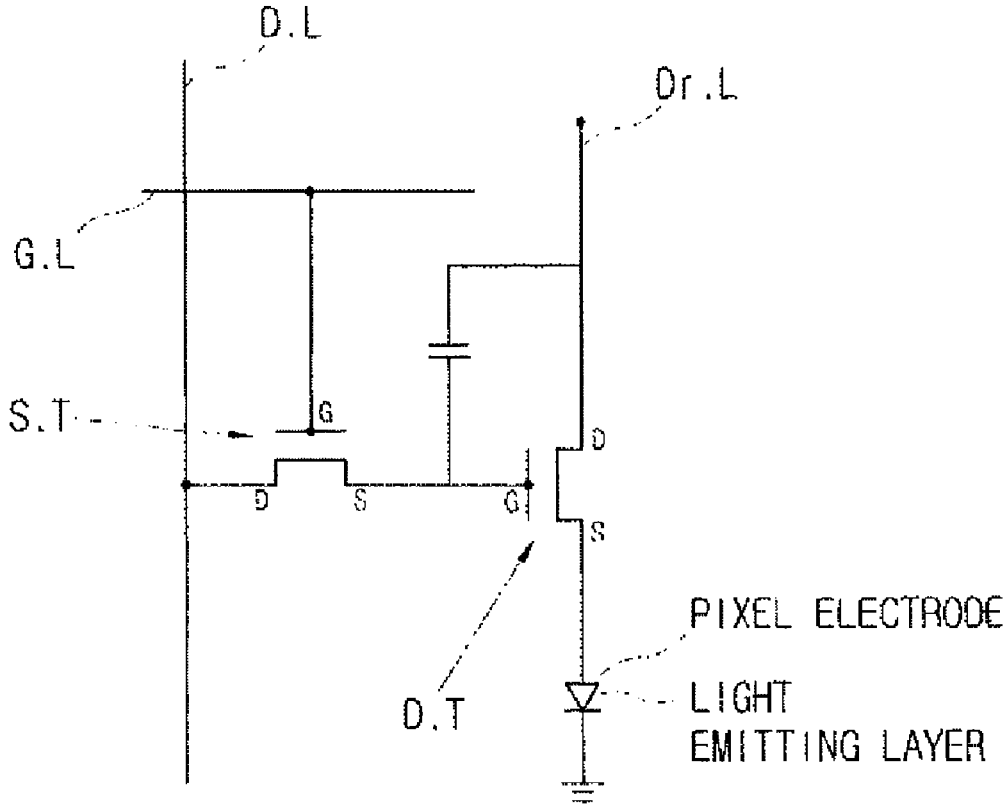
FIG. 2 is an equivalent circuit diagram of a pixel in the display device according to the first exemplary embodiment of the present invention.

As shown in FIG. 1 and FIG. 2, a display device according to an exemplary embodiment of the present invention includes a display region A formed in a display panel 100; a gate driver 110 arranged in a non-display region outside the display region A; a driver generating a driving signal such as a gate signal and a data signal; and voltage pads 140 and 150. The driver includes a circuit board 130 mounted with circuits to generate various signals, a flexible member 121 electrically connecting the circuit board 130 and the display panel 100, and a data driver 120 disposed on the flexible member 121 and applying a data signal. The voltage pads 140 and 150 are connected to a flexible film 160, and one end of the flexible film 160 is connected to a power generator 310.

The display region A in FIG. 1 includes gate lines (not shown), data lines (not shown), and voltage supply lines. The data lines and voltage supply lines cross with the gate lines and a plurality of pixels are defined by the crossings of the gate, data, and voltage supply lines. Each pixel may have a rectangular shape. Further, a light emitting layer (not shown) is disposed on each of the pixels and a common electrode 20 is disposed across the entire surface of the display region A on the light emitting layers. The voltage supply lines are disposed parallel to the data lines. As a data metal layer, the voltage supply line is generally disposed on the same layer as the data line.

An equivalent circuit of a pixel formed under the common electrode 20 will be described below with reference to FIG. 2.

Referring to FIG. 2, a pixel includes a switching transistor S.T connected to the gate line G.L and a data line D.L, a driving transistor D.T connected to a source electrode S of the switching transistor S.T and the voltage supply line Dr.L, and a pixel electrode connected to the driving transistor D.T. Further, the pixel includes a light emitting layer, which emits light when a voltage is applied by the pixel electrode.

The gate lines G.L are arranged parallel to each other and perpendicularly cross the data line D.L and the voltage supply line Dr.L, thereby defining a pixel. A gate metal layer including the gate line G.L and a gate electrode G of the switching and driving transistors S.T and D.T may be made of a single layer or multiple layers. The gate line G.L supplies a gate on/off voltage to the switching transistor S.T.

Further, a data metal layer, which includes the data line D.L and each drain electrode and source electrode of the switching and driving transistors S.T and D.T, may be insulated from the gate metal layer.

The voltage supply lines Dr.L are arranged parallel to the data line D.L and cross the gate lines G.L, thereby defining pixels in a matrix. The voltage supply line Dr.L includes the data metal layer and is disposed on the same layer as the data line D.L. A voltage supply line Dr.L having this configuration can be provided for each pixel, but it is also possible for two pixels to share one voltage supply line Dr.L. In other words, two pixels adjacent to one voltage supply line Dr.L may both receive a driving voltage through the voltage supply line Dr.L. Accordingly, the number of voltage supply lines Dr.L may be decreased, thereby simplifying the fabricating process. Further, by decreasing the number of voltage supply lines to which the voltage is applied, it may be possible to prevent electromagnetic interference (EMI).

The switching transistor S.T includes a gate electrode G forming a part of the gate line G.L, a drain electrode D branched from the data line D.L, a source electrode S spaced apart from the drain electrode D, and a semiconductor layer interposed between the drain electrode D and the source electrode S. A gate-on voltage applied to the gate line G.L is transferred to the gate electrode G of the switching transistor S.T. Accordingly, the data voltage is applied from the data line D.L to the source electrode S via the drain electrode D.

The driving transistor D.T adjusts a current applied between a drain electrode D and a source electrode S on the basis of the data voltage applied to a gate electrode G thereof. The voltage applied to the pixel electrode through the source electrode corresponds to difference between the data voltage of the gate electrode G and the driving voltage of the drain electrode D.

The pixel electrode is used as an anode, and it supplies holes to the light emitting layer.

Further, the common electrode 20 is formed across the entire display region A, and a current from the light emitting layer flows out through the common electrode 20.

Referring back to FIG. 1, the gate driver 110, which is connected to an end of the gate line, and the data driver 120, which is connected to an end of the data line, are provided on one side of the non-display region. The gate driver 110 and the data driver 120 supply various driving signals to the gate line and the data line, respectively. According to an exemplary embodiment of the present invention, the gate driver 110 may be mounted on the display panel 100 in a chip on glass (COG) manner. When the gate driver 110 is mounted as a chip on the display panel 100, wiring patterns (not shown) disposed on the data driver 120 and the display panel 100 can be used to supply gate-on/off voltages from the circuit board 130 to the gate driver 110. Accordingly, the display device according to one exemplary embodiment of the present invention includes no separate circuit board connected to the gate driver 110.

According to another exemplary embodiment of the present invention, the gate driver 110 may include a shift register connected to each end of the gate lines. The shift register includes a plurality of transistors, which may be directly formed on the display panel 100 when the signal lines are formed. Even though the gate driver 110 is formed as the shift register, various control signals and the gate-on/off voltages applied to the gate line are directly transmitted to the shift register through the wiring lines, so there is no need for a separate circuit board.

The flexible member 121 has a first end attached to the non-display region in the area above the display region A and a second end connected to the circuit board 130. The flexible member 121 may be attached to the display panel 100 and the circuit board 130 by an anisotropic conductive film (not shown). The data driver 120 may be mounted on the flexible member 121, which may easily bend. The flexible member 121 is provided with wiring lines to electrically connect the data driver 120 to the display panel 100 and the circuit board 130.

The circuit board 130 is connected to the data driver 120 through the flexible member 121, and it may include a voltage generator to generate various voltages, such as a gate voltage, a data voltage, etc., to be supplied to the display region A and a timing controller to output various control signals to be transmitted to the gate driver 110 and the data driver 120. Alternatively, the circuit board 130 may be divided into parts such that one part generates a gray-scale voltage and another part receives a video signal, i.e., the circuit board may include a plurality of circuit boards. In other words, a plurality of circuit boards can be connected to each other and connected to the data driver 120. The circuit board 130 is provided with a first external power input unit 131 in a predetermined region to receive external power and a video signal. The external power and the video signal are supplied to the circuit board 130 through a signal cable (not shown) connected to the first external power input unit 131.

The gate and data lines in the display region A extend to an outer circumference region where they are connected to the gate driver 110 and the data driver 120, respectively. Where the gate line is connected to the gate driver there is a gate fan-out part 115 at which the intervals between the gate lines get narrower, and where the data line is connected to the data driver there is a data fan-out part 125 at which the intervals between the data lines get narrower.

The driving voltage pad 140 and the common voltage pad 150 are disposed in the non-display region. The driving voltage pad 140 is connected to one end of the voltage supply line and the common voltage pad 150 is electrically connected to the common electrode 20. The driving voltage pad 140 and the common voltage pad 150 are connected to the voltage supply line and the common electrode 20 with the flexible films 161 and 163, respectively.

The driving voltage pad 140 extends along the side of the display region A opposite the data driver 120 and transmits the driving voltage at a predetermined level from the flexible film 161 to the voltage supply line.

The common voltage pad 150 extends along the side of the display region A opposite the gate driver 110 and transmits the common voltage at a predetermined level from the flexible film 163 to the common electrode 20. FIG. 1 shows that the common electrode 20 and the common voltage pad 150 are spaced apart from each other, but the invention is not limited to this arrangement. Alternatively, the common electrode 20 and the common voltage pad 150 may be either directly connected to each other or indirectly connected through a bridge electrode including indium tin oxide (ITO).

The voltage pads 140 and 150 include a wire forming material such as a gate metal material. Further, the voltage pads 140 and 150 may include any conductive metal layer, as well as the wire forming material. Also, the voltage pads 140 and 150 may include ITO or indium zinc oxide.

The positions of the voltage pads 140 and 150 are not limited to the above-description. For example, the voltage pads 140 and 150 may be placed between the gate driver 110 and the data driver 120. In this case, the driving voltage or the common voltage may be generated in the circuit board 130, and power generated from the power generator 310 may be transmitted through the circuit board 130.

The flexible film 160 comprises a driving flexible film 161 connected to the driving voltage pad 140, and a common flexible film 163 connected to the common voltage pad 150. The flexible films 161 and 163 are electrically separated from each other and supply voltages having different levels to the voltage pads 140 and 150, respectively.

Using an external power supply, the power generator 310 generates the common voltage and the driving voltage, which are applied to the common electrode 20 and the voltage supply line, respectively, at predetermined levels. Preferably, the power generator 310 is positioned adjacent to both the driving voltage pad 140 and the common voltage pad 150. When the power generator 310 is adjacent to both the voltage pads 140 and 150, the flexible film 160 may be shortened and the speed of transmitting an electric signal may increase. Conventional devices mounted the power generator for generating the common voltage and the driving voltage on the circuit board. The common voltage and the driving voltage generated in the circuit board are transmitted to the voltage pads 140 and 150 through a plurality of flexible films and printed circuit boards. In this case, when the voltage is transmitted through the plurality of mediums, a voltage drop may arise due to resistance. Also, the plurality of printed circuit boards may complicate the rear side structure of the display panel. In an exemplary embodiment of the present invention, the separate power generator 310 for generating the common voltage and the driving voltage is placed adjacent to the voltage pads 140 and 150, so that the power can be supplied in stable and reliable manner. Further, this arrangement allows for one side of the display panel 100 to have a simple structure which may make it easier to pack the display panel 100.

Figure 3:
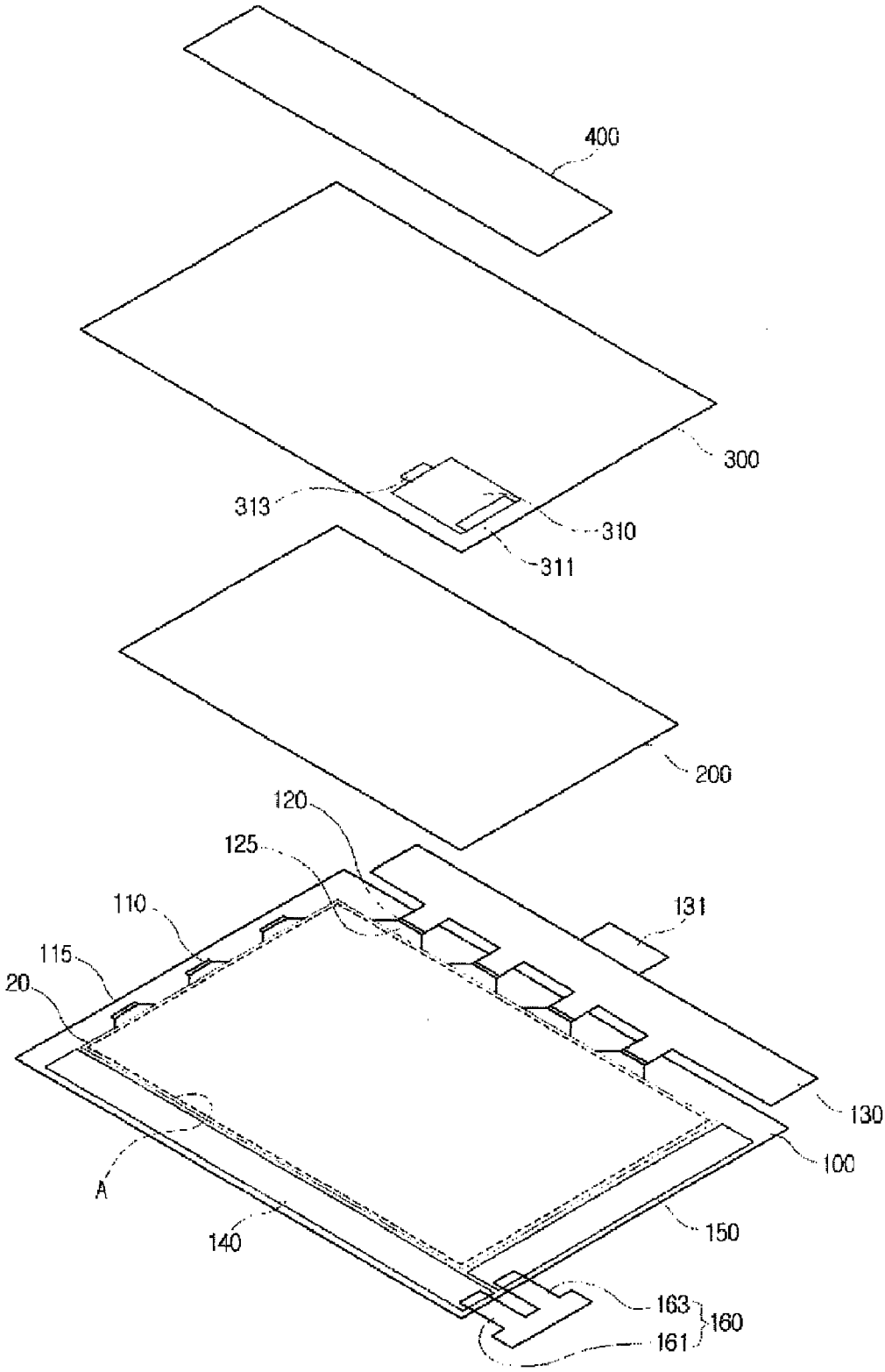
FIG. 3 is an exploded perspective view of a display device according to a second exemplary embodiment of the present invention.
Figure 4:
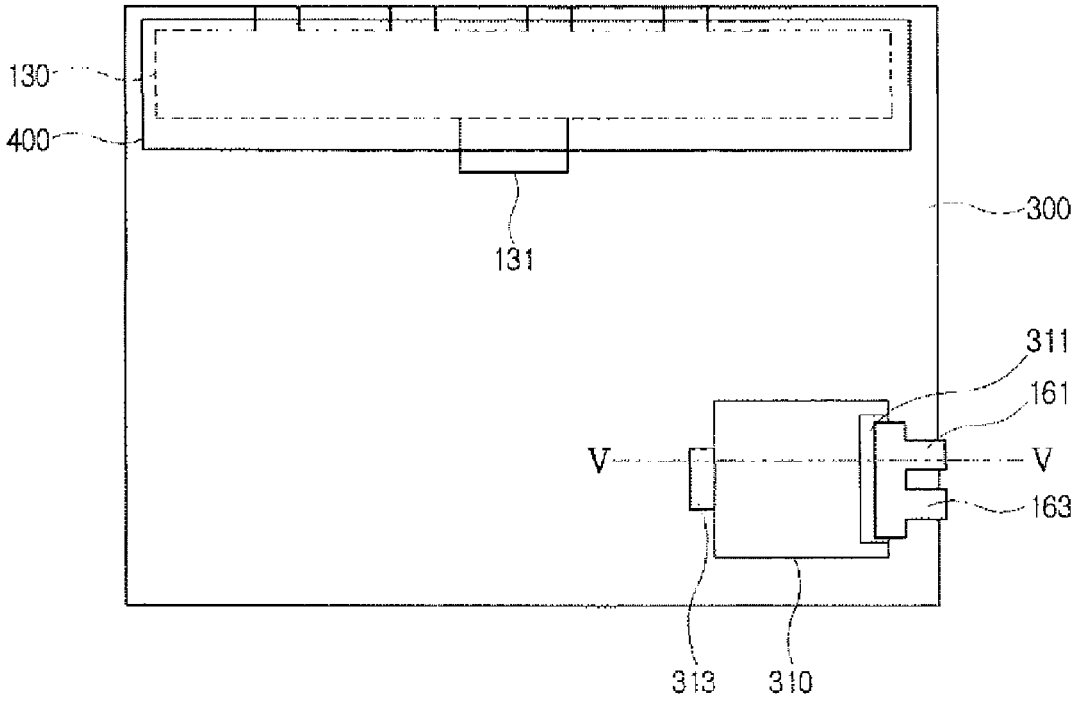
FIG. 4 is a plan view of the display device according to the second exemplary embodiment of the present invention.
Figure 5:
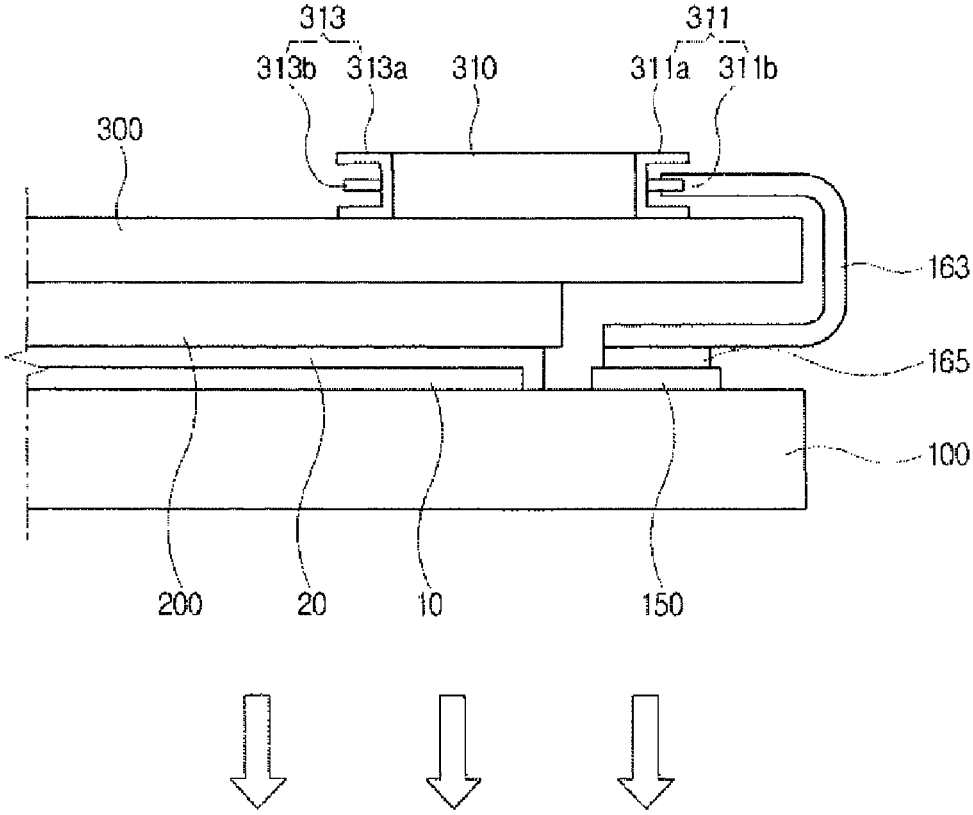
FIG. 5 is a sectional view of the display device taken along line V-V in FIG. 4.

FIG. 3 is an exploded perspective view of the display device according to a second exemplary embodiment of the present invention, FIG. 4 is a plan view of the display device according to the second exemplary embodiment of the present invention, and FIG. 5 is a sectional view of the display device taken along line V-V of FIG. 4.

As shown, a display device according to the second embodiment of the present invention includes a display panel 100, an encapsulation substrate 200 encapsulating a display region A of the display panel 100, and a panel cover 300 protecting and supporting the display panel 100. Further, the display device includes a circuit board cover 400 to protect the circuit board 130 when the circuit board 130 is placed on the panel cover 300. FIG. 4 shows the display panel 100, the encapsulation substrate 200, the panel cover 300, and the circuit board cover 400 shown in FIG. 3 assembled into the display device. Hereinafter, repetitive descriptions to the first embodiment will be avoided as necessary.

As shown in FIG. 3, a data driver 120 according to the second exemplary embodiment of the present invention is provided as a COG mounted on the display panel 100, like the gate driver 110. Accordingly, the flexible member of the first embodiment is not provided and the data driver 120 is directly connected to the circuit board 130. The circuit board 130 is folded onto the rear side of the display region A after the display panel 100 is completed. That is, the circuit board 130 connected to the data driver 120 is bent toward the display panel 100 having display region A, so that it is positioned above the panel cover 300 (refer to FIG. 4).

In this embodiment, a power generator 310 generating a common voltage and a driving voltage is positioned above the panel cover 300, which supports and protects the display panel 100.

After the circuit board 130 and the flexible film 160 are connected to the display panel 100, and the encapsulation substrate 200 is placed on the display panel 100, then the panel cover 300 is placed on the encapsulation substrate 200. The panel cover 300 packages and supports the display panel 100 for easy transport and protection. The panel cover 300 may be made of an insulating material and is electrically insulated from a plurality of signal lines disposed on the display panel 100 and the voltage pads 140 and 150. The panel cover 300 may be made of plastic or other sturdy and light materials.

According to another exemplary embodiment of the present invention, the panel cover 300 may have a predetermined opening in the place where the circuit board 130 is positioned. That is, to make the display device thinner, the panel cover 300 may be partially removed in the place where the circuit board 130 is positioned.

As shown in FIG. 4 and FIG. 5, the flexible film 160 is bent from one side of the display panel 100 having the display region A and is connected to the power generator 310 provided on the panel cover 300. The connection between the common flexible film 163 and the common voltage pad 150 will be described as an example of connection between the flexible film 160 and the voltage pads 140 and 150. An anisotropic conductive film 165 is provided on the common voltage pad 150 to contact the common flexible film 163. The anisotropic conductive film 165 enhances electric contact between the common voltage pad 150 and the common flexible film 163 and absorbs physical shock. The process of connecting the common voltage pad 150 to the common flexible film 163 comprises positioning the anisotropic conductive film 165 and the common flexible film 163 on the common voltage pad 150, and pressing the common flexible film 163 down.

The end of the common flexible film 163 that is not connected to the common voltage pad 150 is connected to a connector 311 provided in the power generator 310. As shown in FIG. 5, the connector 311 includes input pins 311*b* to which the common flexible film 163 is connected, and a main body 311*a* accommodating the input pins 311*b*. One end of the common flexible film 163 is formed with connecting holes (not shown) that may be connected to the input pins 311*b*. The input pins 311*b* are connected to electric wiring lines formed in the power generator 310, and the common flexible film 163 receives an electric signal through the input pins 311*b*.

In addition to the connector 311, the power generator 310 includes a second external power input unit 313 to receive external power. The second external power input unit 313 comprises input pins 313*b* that may be connected to an external power cable and a main body 313*a* accommodating the input pins 313*b* because it is also a kind of connector to be connected with the external power cable.

In the display device according to this exemplary embodiment of the present invention, light is emitted from a light emitting layer 10 through the surface of the display panel 100, which is not covered with the panel cover 300. Accordingly, the power generator 310 connected to the flexible film 160 and the circuit board 130 are positioned on the panel cover 300.

The encapsulation substrate 200 is positioned on the display panel 100, aligned with the display region A, and then adhered to the display panel 100. The encapsulation substrate 200 protects the light emitting layer 10 from moisture and oxygen, thereby preventing the light emitting layer 10 from deterioration. Further, a blocking and/or passivation layer including an organic and/or inorganic material may be interposed between the common electrode 20 and the encapsulation substrate 200 positioned in a top edge of the display panel 100. The blocking layer and/or the passivation layer may be generally made of a material that can be hardened by heat or light, thereby allowing for the display panel 100 and the encapsulation substrate 200 to be easily adhered to each other.

As shown in FIG. 4, the circuit board cover 400 is positioned above the panel cover 300 and covers the circuit board 130 so that it is not exposed to the outside. The circuit board cover 400 is formed as a thin plate, generally made of plastic, and coupled to the panel cover 300 by a screw or other similar coupler. Further, a separate cover having the same function as the circuit board cover 400 may be provided above the power generator 310.

Figure 6:
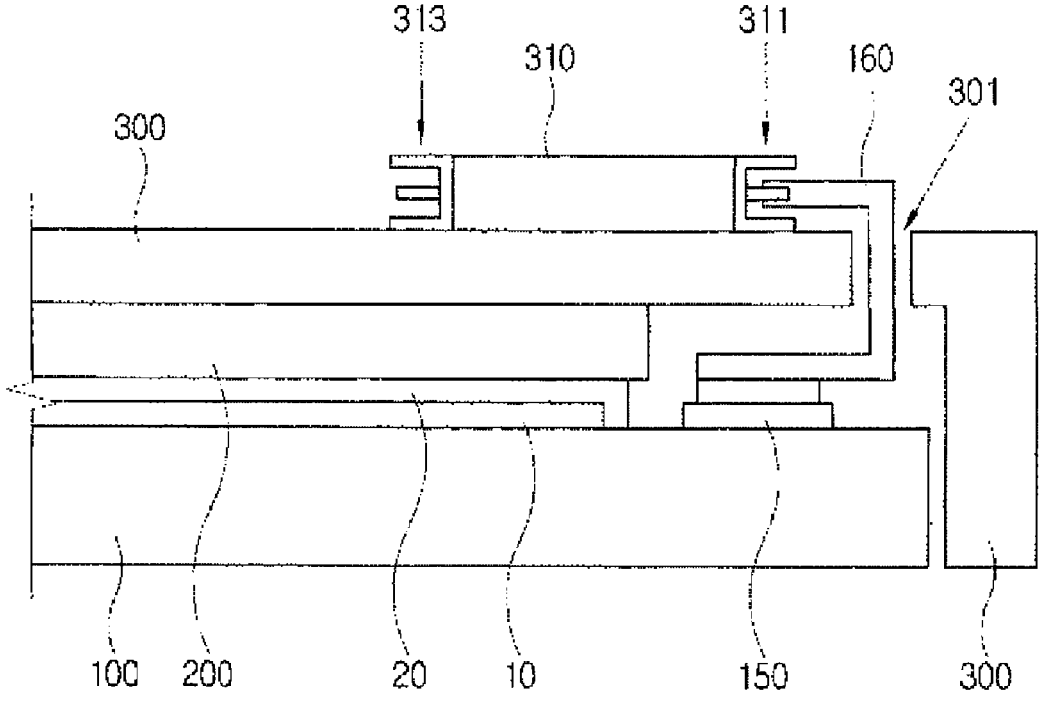
FIG. 6 is a sectional view of a display device according to a third exemplary embodiment of the present invention.

FIG. 6 is a sectional view of a display device according to a third exemplary embodiment of the present invention.

In the third exemplary embodiment, a panel cover 300 does not have the plate shape of the second exemplary embodiment, but rather, has a box shape including a first surface parallel to the display panel 100 and a second surface surrounding a lateral side of the display panel 100. As the panel cover 300 has a box shape corresponding to the display panel 100, it is able to protect the lateral side of the display panel 100, i.e., it can prevent the flexible film 160 from being exposed to the outside. Even though the flexible film 160 is connected to a power generator 310 with tension, a predetermined space is formed between the flexible film 160 and the lateral side of the display panel 100, making it possible that problems will arise in connection and safety of the flexible film 160. Accordingly, to avoid these problems, the panel cover 300 is provided to have a box shape, and the panel cover 300 has a predetermined opening 301.

The opening 301 is formed in the bottom of the panel cover 300 so that the flexible film 160 is not exposed to the outside and is readily connected to the power generator 310. The flexible film 160 that is connected to the common voltage pad 150 positioned within the space formed by the panel cover 300 can extend out of that space through the opening 301.

The shapes of the panel cover 300 and the opening 301 are not limited to the foregoing descriptions, and may vary as long as the display panel 100 remains supported and protected.

Figure 7:
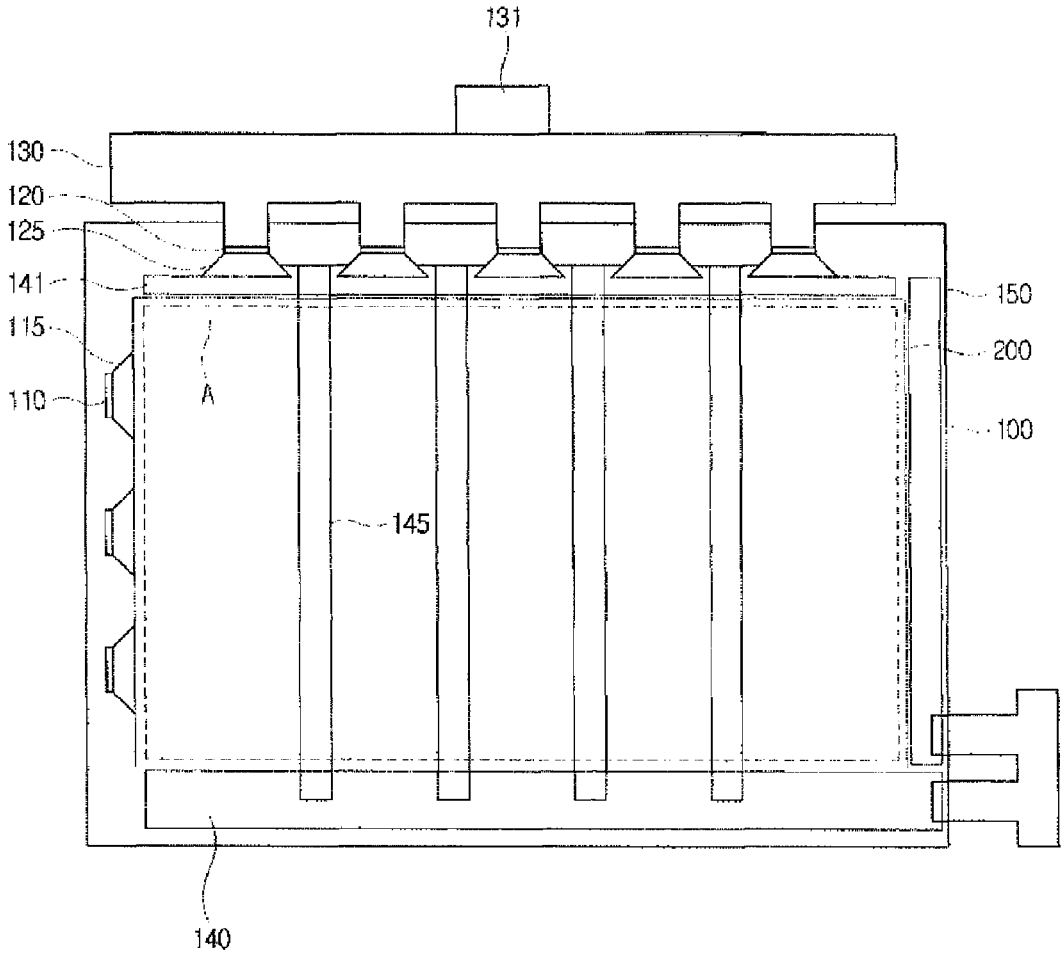
FIG. 7 is a schematic view of a display panel according to a fourth exemplary embodiment of the present invention.

FIG. 7 is a schematic view of a display panel according to a fourth exemplary embodiment of the present invention.

In the fourth exemplary embodiment, a display panel 100 includes an additional driving voltage pad 141 provided along one side of a display region A, in which the data driver 120 is disposed. The additional driving voltage pad 141 extends between the data drivers 120 and has a bar shape parallel to the gate line. Further, an additional common voltage pad (not shown) may be provided along one side of the display region A, in which the gate driver 110 is disposed.

The common voltage and the driving voltage should be fully supplied to the display panel 100, even when the size of display panel 100 increases. Preferably, a plurality of voltage pads are provided for fully supplying the common voltage and the driving voltage to a relatively large sized display panel. Accordingly, the voltage pad 141 is additionally formed between the drivers 120, and the separated voltage pads 140 and 141 are connected by a connecting member 145.

The connecting member 145 transmits the driving voltage from the driving voltage pad 140 to the additional driving voltage pad 141. Preferably, a plurality of connecting members 145 are provided to efficiently transmit the driving voltage. The connecting member 145 is placed on the encapsulation substrate 200 and includes metal, such as copper, having low resistance. Alternatively, the connecting member 145 may include a lightweight flexible film. When the voltage is applied through the plurality of connecting members 145, the respective connecting members 145 preferably have the same area, are spaced at the same intervals, and are arranged in parallel with each other so that any voltage drop due to resistance is uniform.

The number, the shape, and the position of voltage pads 140, 141, and 150 may vary according to the size of the display panel 100 and the light emitting directions. Further, the length and the shape of the flexible film 160 may vary according to the position of the power generator 310 that supplies power to the voltage pads 140, 141, and 150.

As described above, the present invention provides a display device which may have an improved structure of manufacturing modularization and a method of manufacturing the same.

It will be apparent to those skilled in the art that various modifications and variations may be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel comprising a display region comprising a plurality of thin film transistors;

a light emitting layer disposed in the display region;

a driver to supply a driving signal comprising a gate signal and a data signal to the thin film transistors;

a voltage pad disposed outside of the display region on the display panel, the voltage pad to supply a reference voltage to the display region;

a power generator to generate the reference voltage;

a flexible film connected between the voltage pad and the power generator to transmit the reference voltage; and a panel cover protecting and supporting the display panel, wherein at least one of the driver and the power generator comprises an external power input unit to receive external power, and wherein the power generator is positioned adjacent to the voltage pad and disposed on the panel cover.

2. The display device of claim 1, wherein the driver comprises:

a circuit board to generate the driving signal;

a flexible member to connect the display panel with the circuit board; and a data driver disposed on the flexible member.

3. The display device of claim 1, wherein the driver comprises:

a circuit board to generate the driving signal and a data driver connected to the circuit board, the data driver being mounted on the display panel.

4. The display device of claim 2, further comprising:

data lines connected to the data driver to receive the data signal;

gate lines crossing the data lines; and a plurality of gate drivers disposed outside of the display region to supply the gate signal to the gate lines, wherein the gate driver is mounted on the display panel and receives the gate signal through the data driver.

5. The display device of claim 4, wherein the gate driver comprises a shift register connected to the gate lines.

6. The display device of claim 3, further comprising:

data lines connected to the data driver to receive the data signal;

gate lines crossing the data lines; and a plurality of gate drivers disposed outside of the display region to supply the gate signal to the gate lines, wherein the gate driver is mounted on the display panel and receives the gate signal through the data driver.

7. The display device of claim 6, wherein the gate driver comprises a shift register connected to the gate lines.

8. The display device of claim 1, wherein the driver is partially disposed on the panel cover, and the display device further comprises a driver cover covering the driver.

9. The display device of claim 1, wherein the reference voltage comprises a driving voltage, the display panel further comprises voltage supply lines disposed within the display region, and the voltage pad comprises a voltage supply pad to supply the driving voltage to the voltage supply lines.

10. The display device of claim 1, wherein the reference voltage comprises a common voltage, the display panel further comprises a common electrode disposed on the light emitting layer, and the voltage pad comprises a common voltage pad to supply the common voltage to the common electrode.

11. The display device of claim 1, further comprising an anisotropic conductive film disposed between the voltage pad and the flexible film.

12. The display device of claim 1, wherein the power generator comprises a connector to which one end of the flexible film is connected.

13. The display device of claim 1, wherein the panel cover comprises:

a first surface parallel to the display panel;

a second surface extending from the first surface and surrounding a lateral side of the display panel; and an opening formed in a region of the first surface, wherein the flexible film passes through the opening.

14. The display device according to claim 1, further comprising:

an encapsulation substrate disposed between the display panel and the panel cover, the encapsulation substrate covering the display region.

15. The display device of claim 1, wherein light is emitted from the light emitting layer to the side of the display panel on which the panel cover is not disposed.

16. A method for manufacturing a display device, comprising:

providing a display panel comprising a display region comprising a light emitting layer, and a voltage pad to supply a voltage to the display region;

providing an encapsulation substrate to encapsulate the display region;

connecting the voltage pad with a first end of a flexible film;

providing a panel cover on the encapsulation substrate, the panel cover comprising a power generator to generate the voltage to be supplied to the display region; and bending the flexible film and connecting a second end of the flexible film to the power generator, wherein the power generator is positioned adjacent to the voltage pad.

17. The method of claim 16, wherein the power generator comprises a connector, and wherein connecting the second end of the flexible film to the power generator comprises connecting the second end of the flexible film to the connector.

* * * * *